US011384776B2

(12) United States Patent
Bao et al.

(10) Patent No.: US 11,384,776 B2
(45) Date of Patent: Jul. 12, 2022

(54) ELECTRIC PUMP

(71) Applicant: Zhejiang Sanhua Intelligent Controls Co., Ltd., Shaoxing (CN)

(72) Inventors: Junfeng Bao, Zhejiang (CN); Qiang Ning, Zhejiang (CN)

(73) Assignee: Zhejiang Sanhua Intelligent Controls Co., Ltd., Shaoxing (CN)

( * ) Notice: Subject to any disclaimer, the term of this patent is extended or adjusted under 35 U.S.C. 154(b) by 122 days.

(21) Appl. No.: 16/640,701

(22) PCT Filed: Jun. 22, 2018

(86) PCT No.: PCT/CN2018/092349
§ 371 (c)(1),
(2) Date: Feb. 20, 2020

(87) PCT Pub. No.: WO2019/037531
PCT Pub. Date: Feb. 28, 2019

(65) Prior Publication Data

US 2020/0355187 A1 Nov. 12, 2020

(30) Foreign Application Priority Data

Aug. 23, 2017 (CN) ..... 201710731154.1

(51) Int. Cl.
*F04D 13/06* (2006.01)
*F04D 29/42* (2006.01)
*F04D 29/58* (2006.01)

(52) U.S. Cl.
CPC ..... *F04D 29/5813* (2013.01); *F04D 13/064* (2013.01); *F04D 13/0606* (2013.01);
(Continued)

(58) Field of Classification Search
CPC ..... F04D 13/0686; F04D 29/426; F04D 29/5813; F04D 13/0606; F04D 13/0626;
(Continued)

(56) References Cited

U.S. PATENT DOCUMENTS 4,774,430 A * 9/1988 Rodriguez ..... H01R 39/39 310/239
7,301,771 B2 * 11/2007 Hata ..... G06F 1/203 165/80.3
(Continued)

FOREIGN PATENT DOCUMENTS

CN 204003495 A 12/2014
CN 104362799 A 2/2015
(Continued)

OTHER PUBLICATIONS

English translation of JP-2006257912 (Year: 2006).*
(Continued)

*Primary Examiner* — Dominick L Plakkoottam
(74) *Attorney, Agent, or Firm* — Wolf, Greenfield & Sacks, P.C.

(57) ABSTRACT

An electric pump includes a pump housing, a rotor assembly, a stator assembly, an isolation sleeve, a heat dissipation plate and an electric control board. The pump housing defines a pump inner chamber; the pump inner chamber is partitioned into a first cavity and a second cavity by the isolation sleeve; the rotor assembly is disposed in the first cavity; the stator assembly and the electric control board are disposed in the second cavity; the isolation sleeve comprises a bottom portion; at least a portion of the heat dissipation plate is disposed between the electric control board and the bottom portion; at least a portion of the bottom portion and at least a portion of the heat dissipation plate are in direct contact, or are filled with thermal silicone grease or thermal silica
(Continued)

therebetween, or are provided with a thermal patch therebetween.

13 Claims, 9 Drawing Sheets

(52) U.S. Cl.
CPC ..... *F04D 13/0626* (2013.01); *F04D 29/426* (2013.01); *F04D 13/0686* (2013.01); *F04D 29/5893* (2013.01); *F05D 2300/10* (2013.01)

(58) Field of Classification Search
CPC .. F04D 29/026; F04D 29/588; F04D 29/5893; F04D 13/064; F04D 13/0693; F04D 1/00; F04D 29/5806; F04D 29/628
See application file for complete search history.

(56) References Cited

U.S. PATENT DOCUMENTS

| | | | | |
|---|---|---|---|---|
| 2004/0037719 | A1 | 2/2004 | Sunaga et al. | |
| 2005/0191888 | A1* | 9/2005 | Ortt | H01R 39/41 439/189 |
| 2008/0118380 | A1 | 5/2008 | Nakanishi | |
| 2014/0010684 | A1 | 1/2014 | Joschko et al. | |
| 2014/0017073 | A1* | 1/2014 | Muizelaar | F04D 29/026 415/177 |
| 2014/0140111 | A1* | 5/2014 | Inaba | H01F 27/255 363/37 |
| 2016/0265538 | A1* | 9/2016 | Lee | F04D 13/0686 |
| 2016/0281718 | A1* | 9/2016 | Zhang | F04D 13/0646 |
| 2017/0009778 | A1* | 1/2017 | Ye | F04D 25/06 |

FOREIGN PATENT DOCUMENTS

| | | | | | |
|---|---|---|---|---|---|
| CN | 104471252 | A | | 3/2015 | |
| CN | 204493214 | U | | 7/2015 | |
| CN | 105952652 | A | | 9/2016 | |
| CN | 206054322 | U | | 3/2017 | |
| GB | 2 496 014 | A | | 5/2013 | |
| JP | H08-042482 | A | | 2/1996 | |
| JP | 2003-222094 | A | | 8/2003 | |
| JP | 2006-257912 | A | | 9/2006 | |
| JP | 2006257912 | A | * | 9/2006 | |
| JP | 2008-128076 | A | | 6/2008 | |
| JP | 2011226342 | A | * | 11/2011 | F04D 13/0686 |
| JP | 2013-099021 | A | | 5/2013 | |
| JP | 2014-025471 | A | | 2/2014 | |
| JP | 2015-136280 | A | | 7/2015 | |
| JP | 2015-151985 | A | | 8/2015 | |
| JP | 2016-021838 | A | | 2/2016 | |

OTHER PUBLICATIONS

English translation of JP-2011226342 (Year: 2011).*
10-2020-7007659, Dec. 31, 2020, Dec. 31, 2020.
Office Action for Japanese Application No. 2020-511209, dated Jan. 26, 2021.
201710731154.1, Feb. 3, 2020, First Office Action.
First Office Action for Korean Application No. 10-2020-7007659, dated Dec. 31, 2020.
PCT/CN2018/092349, Sep. 20, 2018, International Search Report and Written Opinion.
JP2020-511209, Jan. 26, 2021, Office Action.
First Office Action for Chinese Application No. 201710731154.1, dated Feb. 3, 2020.
International Search Report and Written Opinion for International Application No. PCT/CN2018/092349, dated Sep. 20, 2018.
Third Office Action for Japanese Application No. 2020-511209, dated Mar. 8, 2022.

* cited by examiner

ELECTRIC PUMP

RELATED APPLICATIONS

This application is the national phase of International Application No. PCT/CN2018/092349, titled "ELECTRIC PUMP", filed on Jun. 22, 2018, which claims priority to Chinese Patent Application No. 201710731154.1, titled "ELECTRIC PUMP", filed on Aug. 23, 2017 with the National Intellectual Property Administration, PRC. The entire contents of these applications are incorporated herein by reference in their entirety.

FIELD

The present application relates to a fluid pump, and in particular to an electric pump.

BACKGROUND

The automobile industry is developing rapidly. With the automobile performance developing toward safer, more reliable, more stable, fully automated, intelligent and environment-friendly and energy saving, electric pumps are widely used in vehicle thermal management systems, and can meet the market requirements.

The electric pump includes an electronic control unit, and the electronic control unit includes an electronic control board. For a high-power pump, the electronic control unit generates heat during working. If the heat is accumulated to a certain extent and cannot be dissipated in time, the performance of the electronic control board will be affected, thereby reducing the service life of the electric pump.

SUMMARY

An object of the present application is to provide an electric pump, which is beneficial to the heat dissipation of the electronic control board, thereby improving the service life of the electric pump.

In order to achieve the above object, the following technical solutions are provided according to the present application.

An electric pump includes a pump housing, a rotor assembly, a stator assembly and an electronic control board. The pump housing is provided with a pump inner chamber, and the pump inner chamber includes a first chamber and a second chamber. The rotor assembly is arranged in the first chamber, and the stator assembly and the electronic control board are arranged in the second chamber. The electric pump includes an isolation sleeve, and at least part of the isolation sleeve is arranged between the rotor assembly and the stator assembly. The first chamber is arranged on one side of the isolation sleeve, and the second chamber is arranged on another side of the isolation sleeve. The electric pump further includes a heat dissipation plate. The isolation sleeve includes a bottom portion, and at least part of the heat dissipation plate is arranged between the electronic control board and the bottom portion. At least part of the bottom portion is in direct contact with at least part of the heat dissipation plate, or silicone grease or silica gel is filled between the at least part of the bottom portion and the at least part of the heat dissipation plate, or heat conducting patches are provided between the at least part of the bottom portion and the at least part of the heat dissipation plate.

Such arrangement is beneficial to the heat dissipation of the electronic control board, thereby prolonging the service life of the electric pump.

An electric pump includes a pump housing, a rotor assembly, a stator assembly and an electronic control board. The pump housing is provided with a pump inner chamber, and the pump inner chamber includes a first chamber and a second chamber. The rotor assembly is arranged in the first chamber, and the stator assembly and the electronic control board are arranged in the second chamber. The electric pump includes an isolation sleeve, and at least part of the isolation sleeve is arranged between the rotor assembly and the stator assembly. The electric pump further includes a heat dissipation plate. Part of the heat dissipation plate and the isolation sleeve form part of the first chamber, and at least part of the heat dissipation plate is arranged between the isolation sleeve and the electronic control board. Such arrangement is beneficial to the heat dissipation of the electronic control board, thereby prolonging the service life of the electric pump.

DETAILED DESCRIPTION OF THE EMBODIMENTS

The present application is further illustrated hereinafter in conjunction with drawings and specific embodiments.

The electric pump in the following embodiments can provide a working medium of a vehicle thermal management system with the power to flow, wherein the working medium is clean water or 50% aqueous solution of ethylene glycol.

Figure 1:
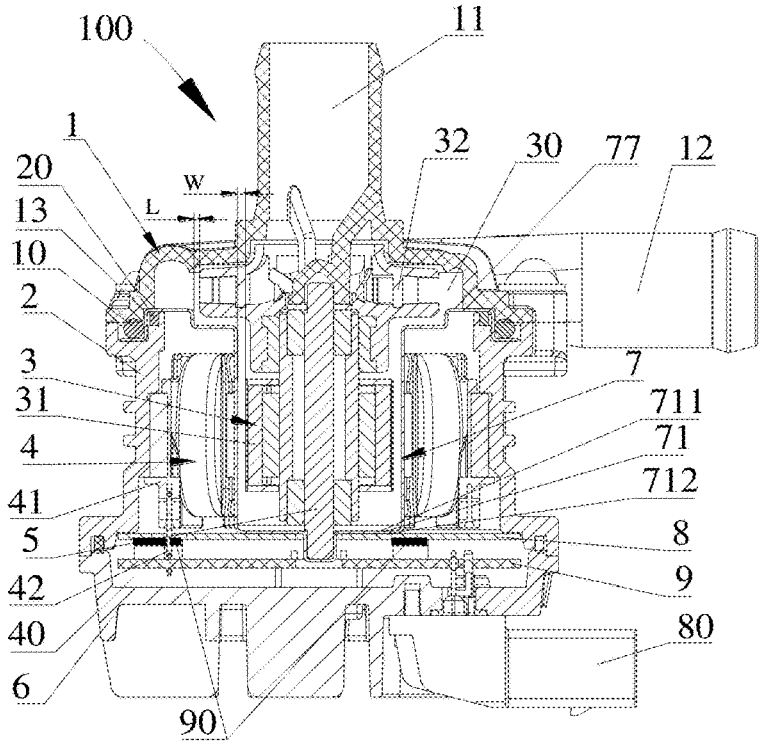
FIG. 1 is a schematic sectional view of a first embodiment of an electric pump according to the present application.

Referring to FIG. 1, FIG. 1 is a schematic structural view of the first embodiment of the electric pump. The electric pump 100 includes a pump housing, a rotor assembly 3, a stator assembly 4, a pump shaft 5 and an electronic control board 9. The pump housing includes a first housing 1, a second housing 2 and a bottom cover 6. The first housing 1, the second housing 2 and the bottom cover 6 are relatively fixed to each other. In the present embodiment, a connection portion between the first housing 1 and the second housing 2 is provided with a first annular sealing ring 10. A structure with the first annular sealing ring 10 can prevent the working medium from oozing out at the connection portion, and prevent an external medium from infiltrating into a pump inner chamber. The pump housing can form the pump inner chamber, and the pump inner chamber is partitioned into a first chamber and a second chamber. Specifically, in the present embodiment, the electric pump 100 further includes an isolation sleeve 7. The first chamber 30 is arranged on one side of the isolation sleeve 7, and the second chamber 40 is arranged on another side of the isolation sleeve 7. The working medium can flow through the first chamber 30, while no working medium flows through the second chamber 40. The rotor assembly 3 is arranged in the first chamber 30, and includes a rotor 31 and an impeller 32. Part of the impeller 32 is arranged in the isolation sleeve 7, the stator assembly 4 and the electronic control board 9 are arranged in the second chamber 40, and the stator assembly 4 is electrically connected to the electronic control board 9. In the present embodiment, a second annular sealing ring 20 is provided between the isolation sleeve 7 and the pump housing, and the structure with the second annular sealing ring 20 can form two defenses, which can totally ensure that the external medium does not infiltrate into the second chamber 40.

Referring to FIG. 1, the first housing 1 is an injection molding part, and is provided with an inlet 11 and an outlet 12 injection molding. When the electric pump 100 is in operation, the working medium enters the first chamber 30 through the inlet 11, and then leaves the first chamber 30 through the outlet. When the electric pump 100 is in operation, a control circuit on the electronic control board 9 is connected to an external power supply by inserting a connector (not shown in the figure) into a socket 80 of the electric pump 100, and the control circuit controls an electric current passing through the stator assembly 4 to change according to a certain rule, thereby enabling the stator assembly 4 to generate a varying magnetic field. The rotor 31 of the rotor assembly 3 rotates around the pump shaft 5 under the action of the magnetic field, thereby enabling the working medium entering the first chamber 30 to rotate with the rotor 31. A centrifugal force generates power for flowing, and the working medium leaves the first chamber 30 due to the centrifugal force.

Referring to FIG. 1, FIG. 1 is a schematic structural view of the first embodiment of the electric pump according to the present application. The electric pump 100 further includes a heat dissipation plate 8, and the heat dissipation plate 8 and the pump housing are separately arranged. The "separately arranged" refers to that the heat dissipation plate and the pump housing are two different parts formed by independent processing. The pump housing may be formed by fixedly connecting two or more parts, and the heat dissipation plate 8 is fixedly connected to the pump housing. The isolation sleeve 7 includes a bottom portion 71, and the bottom portion 71 is closer to the electronic control board 9 than a top portion 77. In the present embodiment, the bottom portion 71 includes an upper surface 711 and a lower surface 712, the lower surface 712 is closer to the electronic control board 9 than the upper surface 711, at least part of the upper surface 711 can be in contact with the working medium in the first chamber 30, and at least part of the lower surface 712 is exposed to the second chamber. At least part of the heat dissipation plate 8 is arranged between the electronic control board 9 and the bottom portion 71, and at least part of the bottom portion 71 is in direct contact with at least part of the heat dissipation plate 8. At least part of the electronic control board 9 is in direct contact with at least part of the heat dissipation plate 8, or silicone grease or silica gel is filled between at least part of the electronic control board 9 and at least part of the heat dissipation plate 8, or heat conducting patches are provided between at least part of the electronic control board 9 and at least part of the heat dissipation plate 8. In the present embodiment, the silicone grease or the silica gel is filled between at least part of the electronic control board 9 and at least part of the heat dissipation plate 8. At least part of the electronic control board 9 may be in direct contact with at least part of the heat dissipation plate 8, or the heat conducting patches may be provided between at least part of the electronic control board 9 and at least part of the heat dissipation plate 8. Such arrangement can better realize heat conduction among the isolation sleeve 7, the heat dissipation plate 8 and the electronic control board 9, which is beneficial to the heat dissipation of the electronic control board 9, thereby prolonging the service life of the electric pump. The "heat conducting patch" in the present embodiment refers to a patch, formed by curing of the silica gel, that has a certain viscosity and can be directly bonded. The stator assembly 4 is electrically connected to the electronic control board 9. The stator assembly 4 includes stators 41 and pins 42, and the heat dissipation plate 8 is located between the stator 41 and the electronic control board 9. With an end of the stator 41 close to the second housing 2 defined as an upper end and another end thereof close to the bottom cover 6 defined as a lower end, the heat dissipation plate 8 is arranged close to the lower end of the stator 41. Such an arrangement allows the heat dissipation plate 8 to be closer to the electronic control board 9, thereby facilitating the heat dissipation of the electronic control board 9. In the present embodiment, the pump inner chamber is partitioned into the first chamber 30 and the second chamber 40 by the isolation sleeve 7. Specifically, the first chamber 30 is arranged on one side of the isolation sleeve 7, and the second chamber 40 is arranged on another side of the isolation sleeve 7.

Figure 2:
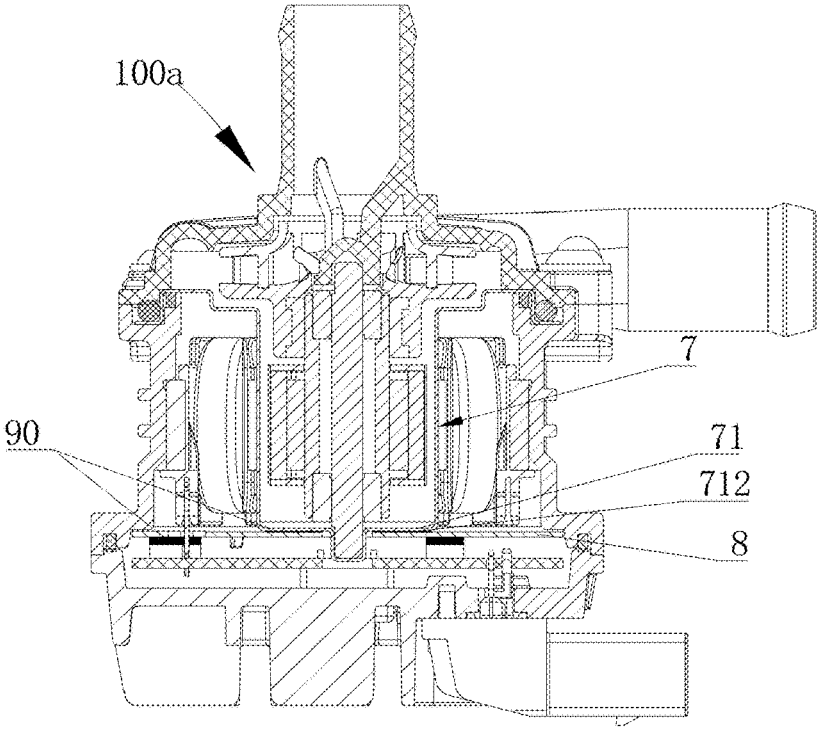
FIG. 2 is schematic sectional view of a second embodiment of the electric pump according to the present application.

Referring to FIG. 2, FIG. 2 is a schematic sectional view of the second embodiment of the electric pump. Compared with the first embodiment of the electric pump, in the electric pump 100*a*, the silicone grease or the silica gel 90 is filled between at least part of the lower surface 712 of the bottom portion 71 of the isolation sleeve 7 and at least part of the heat dissipation plate 8. The heat conducting patches may be provided between at least part of the lower surface 712 of the bottom portion 71 of the isolation sleeve 7 and at least part of the heat dissipation plate 8. The "heat conducting patch" refers to the patch, formed by curing of the silica gel that has a certain viscosity and can be directly bonded. In the present embodiment, the lower surface 712 of the bottom portion 71 of the isolation sleeve 7 is coated with the silicone grease or the silica gel 90, or a portion of the heat dissipation plate 8 corresponding to the lower surface 712 of the bottom portion 71 of the isolation sleeve 7 is coated with the silicone grease or the silica gel 90. Such an arrangement can prevent the heat conduction among the isolation sleeve 7, the heat dissipation plate 8 and the electronic control board 9 from being adversely affected due to the decrease of a contact area between the heat dissipation plate 8 and the isolation sleeve 7 in a case that the lower surface 712 is machined unevenly, and can prevent the heat dissipation efficiency of the electronic control board 9 from being reduced. In the present embodiment, other features of the electric pump are the same as those of the first embodiment of the electric pump, and will not be described herein again.

Figure 6:
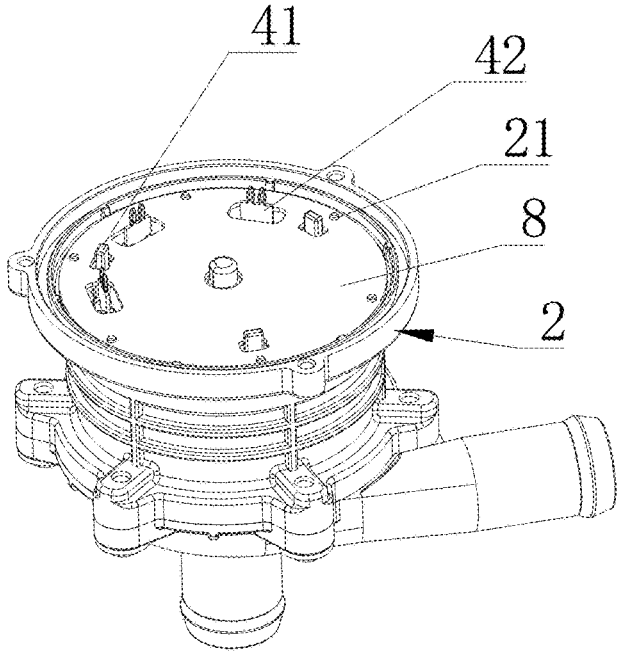
FIG. 6 is a schematic perspective view of the electric pump without an electronic control board and a bottom cover shown in FIG. 1 or FIG. 2.

Referring to FIGS. 3 to 6, a central hole 81 and multiple avoidance holes 82 are provided at a center of the heat dissipation plate 8. The avoidance holes 82 are arranged corresponding to part of the pins 42 and part of the stators 41, which can prevent structural interference when the heat dissipation plate is assembled. The heat dissipation plate 8 is made of metal, specifically, made of copper or aluminum. Referring to FIG. 6, the heat dissipation plate 8 is fixedly connected to the pump housing. The heat dissipation plate 8 includes multiple through holes 83, and the through holes 83 are distributed in a circumferential array or uniformly distributed. The pump housing includes multiple columns 21, and the columns 21 are distributed in the circumferential array or evenly distributed. The columns 21 are integrally formed with the pump housing or fixedly connected with the pump housing. The columns 21 are arranged corresponding to the through holes 83, and the heat dissipation plate 8 is fixedly connected with the pump housing by riveting the columns 21. In the present embodiment, the heat dissipation plate 8 is fixedly connected to the second housing 2, the columns 21 are arranged on the second housing 2, the columns 21 are integrally formed with the second housing 2 or fixedly connected with the second housing 2, and the through holes 83 are arranged corresponding to the columns 21. After the through holes 83 are arranged corresponding to the columns 21, part of the columns 21 are still exposed. The heat dissipation plate 8 is fixedly connected with the second housing 2 by riveting the columns 21. Such an arrangement enables the connection between the heat dissipation plate 8 and the second housing 2 to be more reliable. Apparently, other connection modes may also be used. For example, the pump housing is formed with multiple threaded holes, the threaded holes are distributed in the circumferential array or evenly distributed, the through holes 83 on the heat dissipation plate 8 are arranged corresponding to the threaded holes of the pump housing, and the heat dissipation plate 8 is fixedly connected with the pump housing through screws and bolts. Apparently, the heat dissipation plate 8 may be connected with the pump housing by welding.

Figure 7:
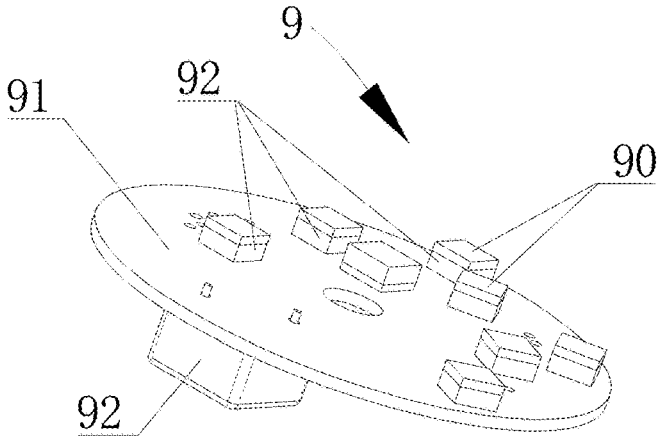
FIG. 7 is a schematic perspective view of a heat dissipation plate shown in FIG. 1 or FIG. 2.
Figure 8:
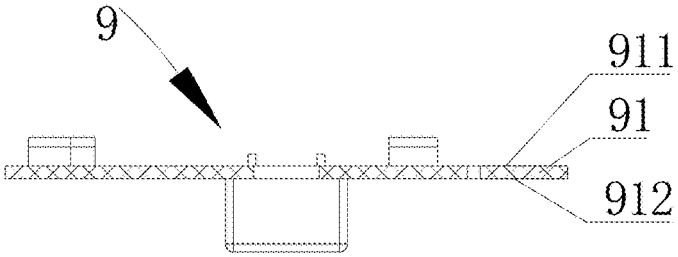
FIG. 8 is a schematic sectional view of the electronic control board shown in FIG. 7.

Referring to FIG. 7 and FIG. 8, FIG. 7 and FIG. 8 are schematic structural views of the electronic control board shown in FIG. 1 and FIG. 2. The electronic control board 9 includes a base board 91 and electronic components 92. The base board 91 includes a front surface 911 and a back surface 912. In the present embodiment, the front surface 911 and the back surface 912 are arranged substantially in parallel, where the "substantially" refers to that the parallelism of the back surface is less than or equal to 1 mm with the front surface as a reference surface. Referring to FIG. 1 or FIG. 2, the front surface 911 of the base board 91 is closer to the lower surface 712 than the back surface 912, and a clearance is formed between the front surface 911 of the base board 91 and the heat dissipation plate 8. At least part of the electronic components 92 are arranged between the front surface 911 and the heat dissipation plate 8. The electronic components 92 include heat-generating electronic components (not shown in the figure), and at least part of the heat-generating electronic components are arranged on the front surface 911 of the base board 91. In the present embodiment, the heat-generating electronic components include diodes, MOS tubes, inductors, resistors, capacitors and the like. Referring to FIG. 1 or FIG. 2, the silicone grease or the silica gel 90 is filled between at least part of the heat dissipation plate 8 and at least part of the heat-generating electronic components (not shown in the figure), or the heat conducting patches are provided between at least part of the heat dissipation plate 8 and at least part of the heat-generating electronic components (not shown in the figure). Referring to FIG. 7, at least upper surfaces of the heat-generating electronic components are coated with the silicone grease or the silica gel 90 or the heat conducting patches, where the "upper surfaces" refer to surfaces of the heat-generating electronic components not connected with the electronic control board 9. Apparently, the silicone grease or the silica gel 90 or the heat conducting patches may be coated on the heat dissipation plate 8 corresponding to the heat-generating electronic components 92. Such an arrangement can conduct the heat generated by the heat-generating electronic components to the heat dissipation plate 8 through the silicone grease or the silica gel or the heat conducting patches, which is beneficial to the heat dissipation of the electronic control board 9, thereby prolonging the service life of the electric pump. Referring to FIG. 1 or FIG. 2, the height of the coated silicone grease or the silica gel 90 or the heat conducting patch is equal to a distance between the electronic control board 9 in FIG. 1 or FIG. 2 and the heat dissipation plate 8 in FIG. 1 or FIG. 2, which can totally ensure that the silicone grease or the silica gel 90 or the heat conducting patch is in full contact with the electronic control board 9 and the heat dissipation plate 8, which is beneficial to the heat dissipation of the electronic control board 9, thereby prolonging the service life of the electric pump. Apparently, at least part of the heat dissipation plate 8 may be in direct contact with at least part of the heat-generating electronic components. Specifically, the heat dissipation plate 8 may be processed into other shapes with different thicknesses according to the height of the heat-generating electronic components, thereby allowing the heat dissipation plate 8 to be in direct contact with the heat-generating electronic components without coating the silicone grease or silica gel, which can also realize the heat dissipation of the electronic control board 9. The "heat conducting patch" refers to the patch, formed by curing of the silica gel that has a certain viscosity and can be directly bonded.

Figure 3:
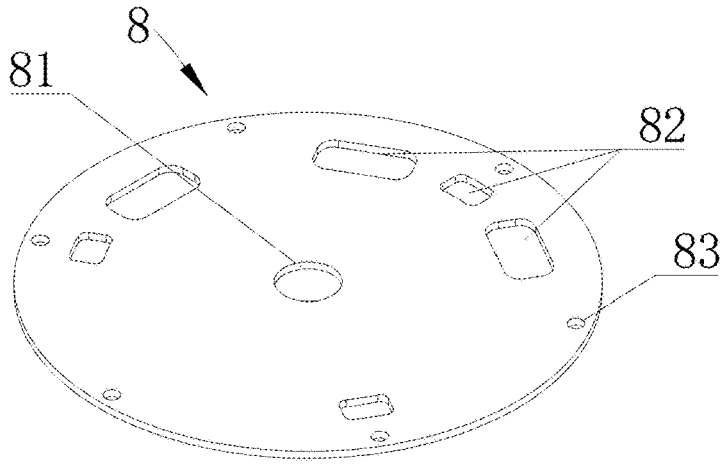
FIG. 3 is a schematic perspective view of a heat dissipation plate shown in FIG. 1 or FIG. 2.
Figure 4:
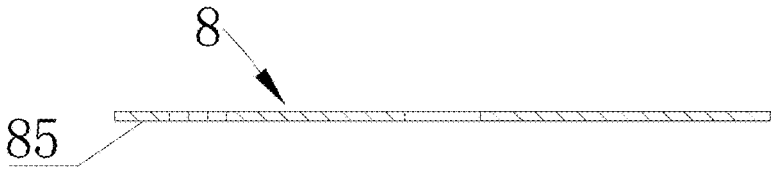
FIG. 4 is a schematic sectional view of the heat dissipation plate shown in FIG. 3.
Figure 5:
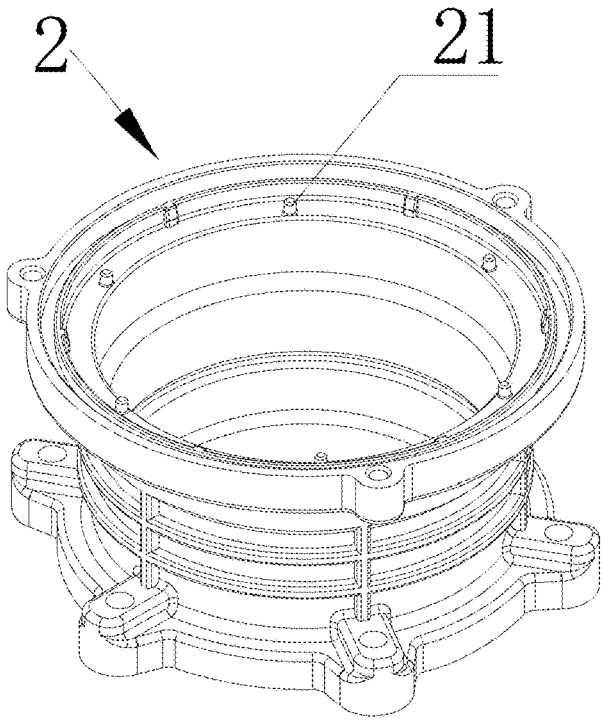
FIG. 5 is a schematic perspective view of a first housing shown in FIG. 1 or FIG. 2.

Referring to FIG. 3 and FIG. 4, the heat dissipation plate 8 is made of metal. In the present embodiment, the heat dissipation plate 8 is made of copper or aluminum. The thickness of the heat dissipation plate 8 is greater than or equal to 0.2 mm. In the present embodiment, the thickness of the heat dissipation plate 8 is greater than or equal to 0.2 mm and less than or equal to 1.5 mm. Such an arrangement not only can reduce a total weight of the electric pump, but also can reserve a certain space between the heat dissipation plate 8 and the heat-generating electronic components for filling the silicone grease or silica gel or the heat conducting patches, while ensuring the strength of the heat dissipation plate 8, thereby having a good heat dissipation effect on the electronic control board 9. Apparently, the thickness of the heat dissipation plate 8 may be greater than 1.5 mm. In this case, the heat dissipation plate 8 can be processed into other shapes with different thicknesses according to the height of the heat-generating electronic components. The heat dissipation plate 8 is in direct contact with the heat-generating electronic components without coating the silicone grease or silica gel. The heat dissipation plate 8 includes a first surface 85, where the "first surface" refers to a surface in direct contact with the electronic control board 9 in FIG. 1 or FIG. 2 or a surface abutting against the silicone grease or silica gel or the heat conducting patches coated between the electronic control board 9 and the first surface. Referring to FIG. 1, the first surface 85 is in direct contact with at least part of the heat-generating electronic components in FIG. 7, or referring to FIG. 2, the silicone grease or silica gel 90 is filled between at least part of the first surface 85 of the heat dissipation plate 8 and at least part of the heat-generating electronic components, or the heat conducting patches are provided between at least part of the first surface 85 of the heat dissipation plate 8 and at least part of the heat-generating electronic components. An area of the first surface 85 of the heat dissipation plate 8 is defined as a first area. Referring to FIG. 7 and FIG. 8, a zone, in which the base board 91 is covered by the heat-generating electronic components arranged on the front surface 911 of the base board 91, is defined as a first zone, an area of the first zone is defined as a second area, and the first area is greater than or equal to the second area. Such an arrangement can fully ensure that there is a large contact area between the heat-generating electronic components arranged on the front surface 911 of the base board 91 and the heat dissipation plate 8, thereby facilitating the heat dissipation.

Figure 9:
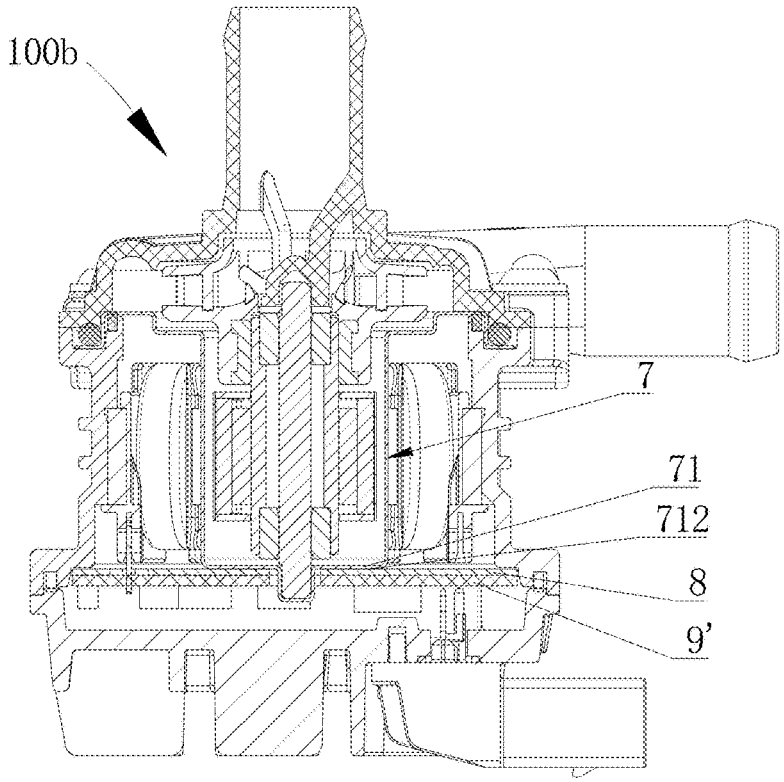
FIG. 9 is a schematic sectional view of a third embodiment of the electric pump according to the present application.
Figure 10:
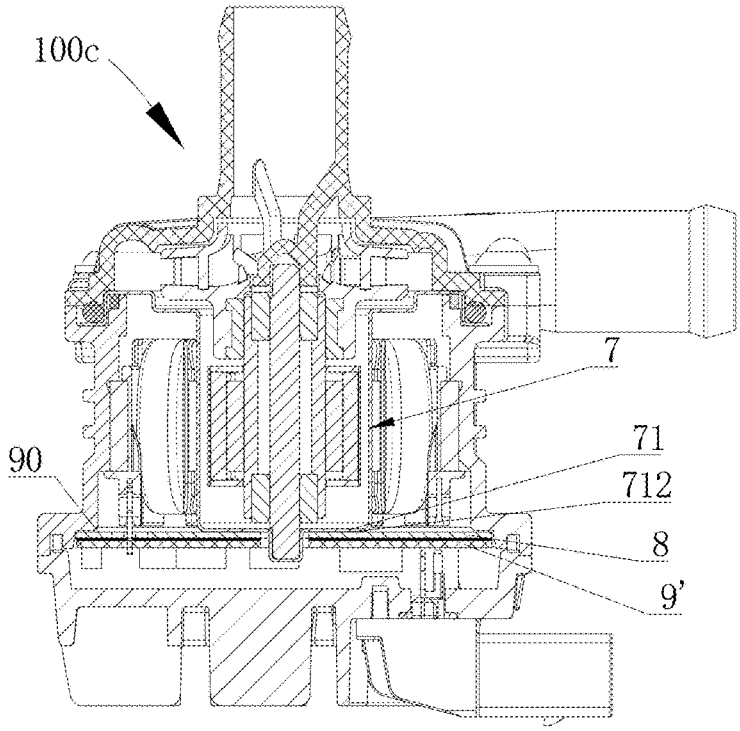
FIG. 10 is a schematic sectional view of a fourth embodiment of the electric pump according to the present application.
Figure 11:
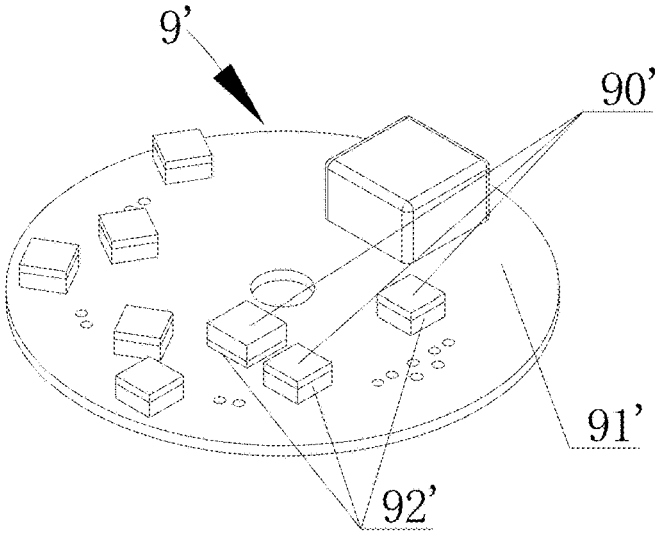
FIG. 11 is a schematic perspective view of the heat dissipation plate shown in FIG. 9 or FIG. 10.
Figure 12:
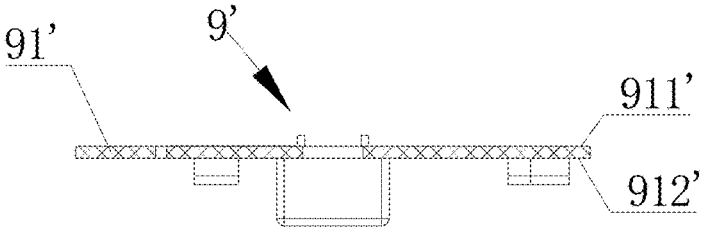
FIG. 12 is a schematic sectional view of the electronic control board shown in FIG. 11.

Referring to FIG. 9 and FIG. 10, FIG. 9 is a schematic sectional view of the third embodiment of the electric pump according to the present application. FIG. 10 is a schematic sectional view of the fourth embodiment of the electric pump according to the present application. Referring to FIG. 9 to FIG. 12, an electronic control board 9' includes a base board 91' and electronic components 92'. The base board 91' includes a front surface 911' and a back surface 912'. In the present embodiment, the front surface 911' and the back surface 912' are arranged substantially in parallel, where the "substantially" refers to that the parallelism of the back surface is less than or equal to 1 mm with the front surface as a reference surface. The electronic components 92' are arranged on the back surface 912' of the base board 91', the front surface 911' of the base board 91' is closer to the lower surface 712 of the bottom portion 71 of the isolation sleeve 7 than the back surface 912'. The heat dissipation plate 8 is made of metal. Referring to FIG. 9 and FIG. 12, at least part of the heat dissipation plate 8 is in direct contact with the front surface 911' of the base board 91', or referring to FIG. 10 and FIG. 12, the silicone grease or silica gel 90 is filled between at least part of the heat dissipation plate 8 and the front surface 911' of the base board 91', or the heat conducting patches are provided between at least part of the heat dissipation plate 8 and the front surface 911' of the base board 91'. The area of the first surface 85 of the heat dissipation plate 8 in FIG. 3 is defined as the first area, the zone of the base board 91' covered by the electronic components 92' in FIG. 11 is defined as the first zone, the area of the first zone is defined as the second area, and the first area is greater than or equal to the second area. Compared with the first embodiment of the electric pump, in the third and fourth embodiments of the electric pump, the electronic components are mounted at different positions on the electronic control board. Specifically, the electronic components 92' are arranged on the back surface 912' of the base board 91'. Such an arrangement enables an axial dimension of the electric pump to be more compact. Other features of the third and fourth embodiments of the electric pump are the same as those of the first embodiment of the electric pump, and will not be described herein again.

Figure 13:
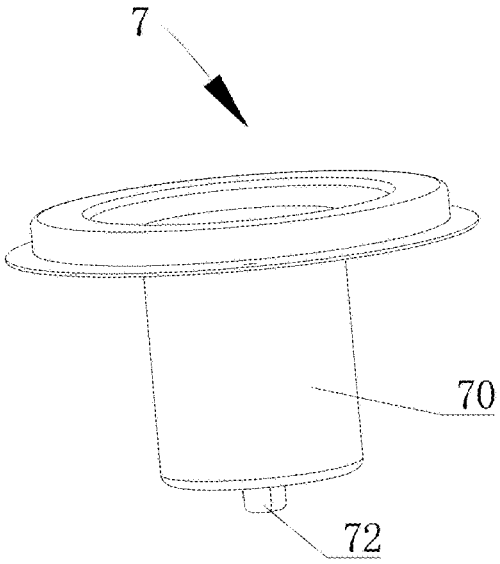
FIG. 13 is a schematic structural view of a first embodiment of an isolation sleeve shown in FIG. 1, FIG. 2, FIG. 9 and FIG. 10.
Figure 14:
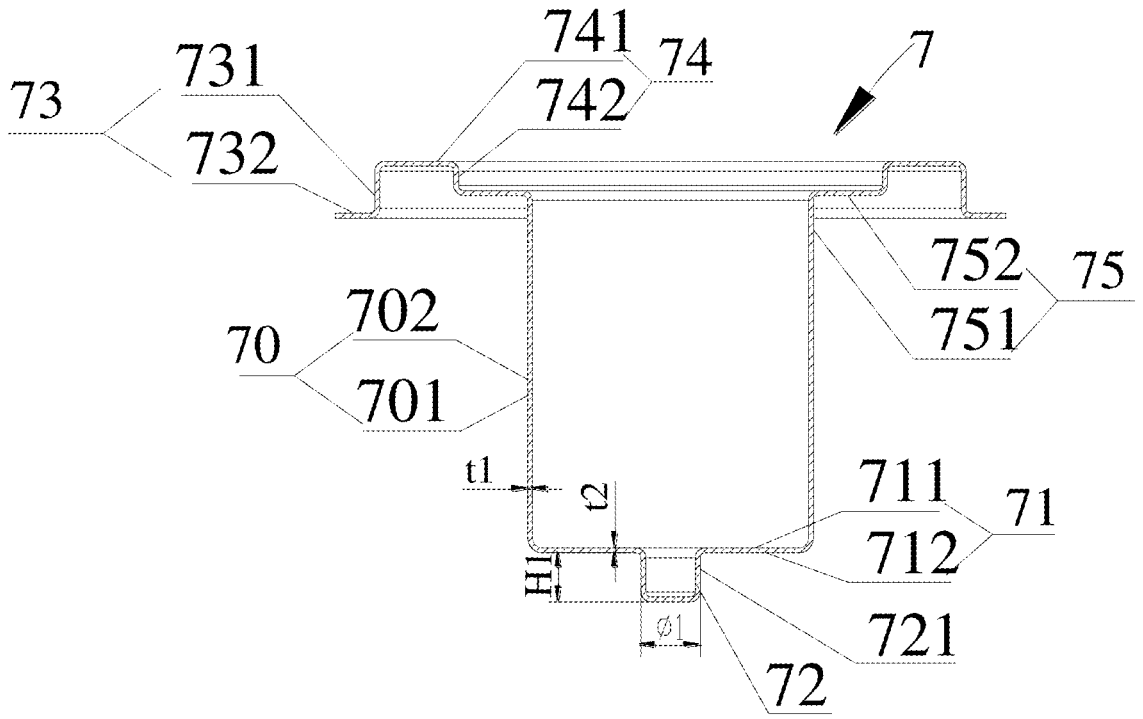
FIG. 14 is a schematic sectional view of the isolation sleeve shown in FIG. 13.

Referring to FIG. 13 and FIG. 14, FIG. 13 and FIG. 14 are schematic structural views of the first embodiment of the isolation sleeve. The isolation sleeve is made of metal having low or no magnetic permeability, where the "low magnetic permeability" refers to that the relative magnetic permeability $\mu r$ is less than 20. In the present embodiment, the isolation sleeve 7 is made of austenitic stainless steel such as the austenitic stainless steel 316L, 304, and 310s. The isolation sleeve 7 includes a sidewall 70 and the bottom portion 71. Referring to FIG. 1 or FIG. 2 or FIG. 9 or FIG. 10, the sidewall 70 is configured to isolating the stator assembly 4 from the rotor assembly 3. In the present embodiment, the stator assembly 4 is sleeved on a periphery of the sidewall 70, and the rotor 31 is sleeved to an inner circumference of the sidewall 70. The sidewall 70 includes an inner surface 701 and an outer surface 702, the inner surface 701 is arranged closer to a central shaft of the isolation sleeve 7 than the outer surface 702. In the present embodiment, the inner surface 701 and the outer surface 702 of the sidewall 70 both are smooth surfaces, that is, both the inner surface 701 and the outer surface 702 are not provided with other structures. Apparently, the inner surface 701 and the outer surface 702 of the sidewall 70 may be provided with other structures. The bottom portion 70 includes the upper surface 711 and the lower surface 712, and the upper surface 711 is closer to an opening side of the isolation sleeve 7 than the lower surface 712. In the present embodiment, the upper surface 711 and the lower surface 712 are both smooth surfaces, that is, both the upper surface 711 and the lower surface 712 are not provided with other structures. Apparently, the upper surface 711 and the lower surface 712 of the bottom portion 71 may be provided with other structures. A minimum distance between a main body portion of the upper surface 711 and a main body portion of the lower surface 712 is defined as a first distance. The "main body portion of the upper surface 711" refers to the feature that accounts for the main portion of the upper surface 711, and the "feature that accounts for the main portion" refers to that the feature accounts for more than 50% of the area of the upper surface 711. The "main body portion of the lower surface 712" refers to the feature that accounts for the main portion of the lower surface 712, and the "feature that accounts for the main portion" refers to that the feature accounts for more than 50% of the area of the lower surface 712. In the present embodiment, the upper surface 711 and the lower surface 712 are both smooth surfaces, that is, both the upper surface 711 and the lower surface 712 are not provided with other structures. A thickness t1 of the sidewall 70 is less than or equal to a thickness of the bottom portion 71. The "thickness of the sidewall 70" refers to a minimum distance between the inner surface 701 and the outer surface 702 of the sidewall 70. The "thickness of the bottom portion 71" is the first distance. On the one hand, such an arrangement can ensure the strength of the bottom portion 71 of the isolation sleeve, and on the other hand, referring to FIG. 1, the thin sidewall 70 is more beneficial to the heat conduction among the working medium, the sidewall 70 of the isolation sleeve 7 and the stator assembly 4, thereby facilitating the heat dissipation of the stator assembly 4. In the present embodiment, the thickness of the sidewall 70 is less than or equal to 1.5 mm. The isolation sleeve 7 is made of stainless steel. Specifically, the isolation sleeve 7 is made of austenitic stainless steel. The isolation sleeve 7 is formed by stamping and stretching a metal plate. The isolation sleeve 7 is provided with a pump shaft position-limiting portion 72, and the pump shaft position-limiting portion 72 is formed at the bottom portion 71. Referring to FIG. 1 or FIG. 2, the pump shaft position-limiting portion 72 protrudes toward the second chamber 40. The heat dissipation plate 8 is provided with a through hole corresponding to the pump shaft position-limiting portion 72, and the pump shaft position-limiting portion 72 passes through the through hole and is positioned to the heat dissipation plate 8. Specifically, referring to FIG. 3, the through hole provided in the heat dissipation plate 8 corresponding to the pump shaft position-limiting portion 72 is the central hole 81 of the heat dissipation plate 8. Referring to FIG. 1 or FIG. 2, the lower surface 712 of the bottom portion 71 is arranged in contact with the heat dissipation plate 8, except for the pump shaft position-limiting portion 72, or a clearance between the lower surface 712 of the bottom portion 71 and the heat dissipation plate 8 is filled with the silicone grease or the silica gel, except for the pump shaft position-limiting portion 72, or the clearance between the lower surface 712 of the bottom portion 71 and the heat dissipation plate 8 is provided with the heat conducting patches, except for the pump shaft position-limiting portion 72. Such an arrangement ensures a large enough contact area between the bottom portion 71 of the isolation sleeve 7 and the heat dissipation plate 8, or ensures that there is as much the silicone grease or the silica gel as possible filled between the bottom portion 71 and the heat dissipation plate 8, which is beneficial to the heat conduction among the isolation sleeve 7, the heat dissipation plate 8 and the electronic control board 9, thereby facilitating the heat dissipation of the electronic control board 9. In the present embodiment, the bottom portion 71 is integrally formed with the sidewall 70. Apparently, the bottom portion 71 and the sidewall 70 may be separately arranged. Specifically, the bottom portion 71 may be fixedly connected with the sidewall 70 by welding or other means.

Figure 15:
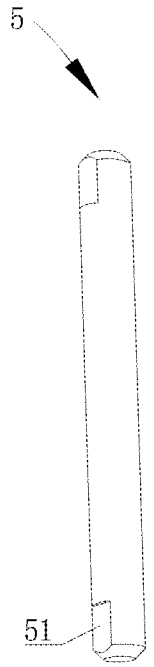
FIG. 15 is a schematic perspective view of a pump shaft shown in FIG. 1, FIG. 2, FIG. 9 and FIG. 10.

Referring to FIG. 14 and FIG. 15, the pump shaft position-limiting portion 72 protrudes away from the opening side of the isolation sleeve 7. The pump shaft position-limiting portion 72 is integrally formed with the isolation sleeve 7 by stamping and stretching. The pump shaft position-limiting portion 72 further includes a first position-limiting portion 721 (that is, the sidewall of pump shaft the position-limiting portion 72), the pump shaft 5 includes a second position-limiting portion 51, the first position-limiting portion 721 is arranged corresponding to the second position-limiting portion 52, and the pump shaft position-limiting portion 72 is fixedly connected with the pump shaft 5 by an interference fit and serves as a lower support of the pump shaft 5. Such an arrangement can prevent circumferential rotation of the pump shaft 5. The isolation sleeve 7 further includes a first step portion 75 and a second step portion 74. The first step portion 75 further includes a first branch portion 752 and a first sub portion 751. The first branch portion 752 is connected with the first sub portion 751, and the first branch portion 752 is closer to the impeller 32 in FIG. 1 than the first sub portion 751. The second step portion 74 includes a second sub portion 742 and a second branch portion 741. With the opening side of the isolation sleeve 7 as an upper side, the second step portion 74 is arranged above the first step portion 75. A diameter of the first sub portion 751 is less than that of the second sub portion 742, such that the impeller 32 in FIG. 1 is partially located in the second sub portion 742, which is beneficial to reducing an overall height of the electric pump 100 on the one hand, and can prevent the impurity particles from easily entering a flow zone between an outer wall of the rotor 31 in FIG. 1 and an inner wall of the isolation sleeve 7 on the other hand, thereby avoiding the accumulation of the impurity particles in the electric pump and prolonging the service life of the electric pump. Referring to FIG. 1 and FIG. 14, a minimum distance L between the second sub portion 742 and a peripheral surface of the impeller 32 in FIG. 1 is less than or equal to 2 mm. Such an arrangement can prevent the impurity particles in the working medium from flowing into the flow zone between the outer wall of the rotor 31 and the inner wall of the isolation sleeve 7, can prevent the accumulation of the impurity particles in the flow zone between the outer wall of the rotor 31 in FIG. 1 and the inner wall of the isolation sleeve 7 in FIG. 1, and can prevent the rotor 31 in FIG. 1 from being stuck by the impurity particles and from stalling, thereby prolonging the service life of the electric pump.

Referring to FIG. 14, the isolation sleeve 7 further includes a third step portion 73. The third step portion 73 includes a third sub portion 731 and a third branch portion 732. Referring to FIG. 1, the first annular sealing ring 10 is provided between the pump housing and the isolation sleeve 7, and at least part of the first annular sealing ring 10 is in contact with at least part of the isolation sleeve 7. In the present embodiment, the first annular sealing ring 10 is sleeved on the third sub portion 731, at least part of the third branch portion 732 and at least part of the third sub portion 731 are in contact with at least part of the first annular sealing ring 10, such that the first annular sealing ring 10 can be initially positioned on the isolation sleeve 7, and the installation of the first annular sealing ring 10 becomes easier and more convenient. Referring to FIG. 3 and FIG. 4, the third sub portion 731 of the third step portion 73 and the second branch portion 741 of the second step portion 74 form a fourth step portion. Referring to FIG. 1, the pump housing includes a step portion 13, and the fourth step portion is arranged corresponding to the step portion 13. In the present embodiment, the step portion 13 is arranged in the first housing 1, and the fourth step portion is arranged corresponding to the step portion 13 of the first housing 1 in FIG. 1, which facilitates the positioning of the first housing 1 when the first housing 1 is mounted, thereby preventing the first housing 1 from laterally moving when the first housing 1 is mounted. Referring to FIG. 1, the second annular sealing ring 20 is arranged between the third sub portion 731 of the third step portion 73 and the second sub portion 742 of the second step portion 74, at least part of the second branch portion 741 of the second step portion 74 is in contact with at least part of the second annular sealing ring 20, such that two defenses can be formed, which fully ensures that the external medium and the working medium cannot infiltrate into the second chamber 40 in FIG. 1, thereby preventing the external medium and the working medium from entering the stator assembly and the circuit board and preventing the external medium and the working medium from damaging the stator assembly and the circuit board.

Referring to FIG. 14, a diameter of the pump shaft position-limiting portion 72 is defined as a first diameter Φ1, and a distance between a bottom surface of the pump shaft position-limiting portion 72 and the lower surface 712 of the bottom portion 71 is defined as a first distance H1. The first distance H1 is less than or equal to the first diameter Φ1, which is advantageous for stretch forming.

Figure 16:
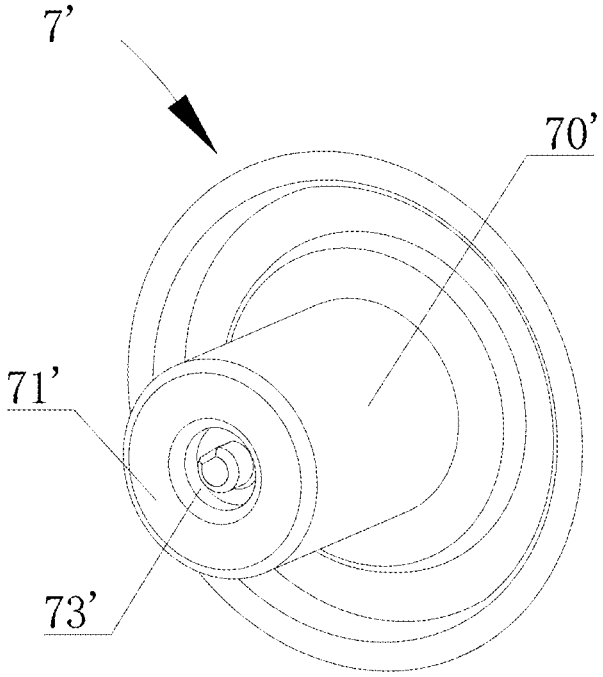
FIG. 16 is a schematic perspective view of a second embodiment of the isolation sleeve shown in FIG. 1, FIG. 2, FIG. 9 and FIG. 10.
Figure 17:
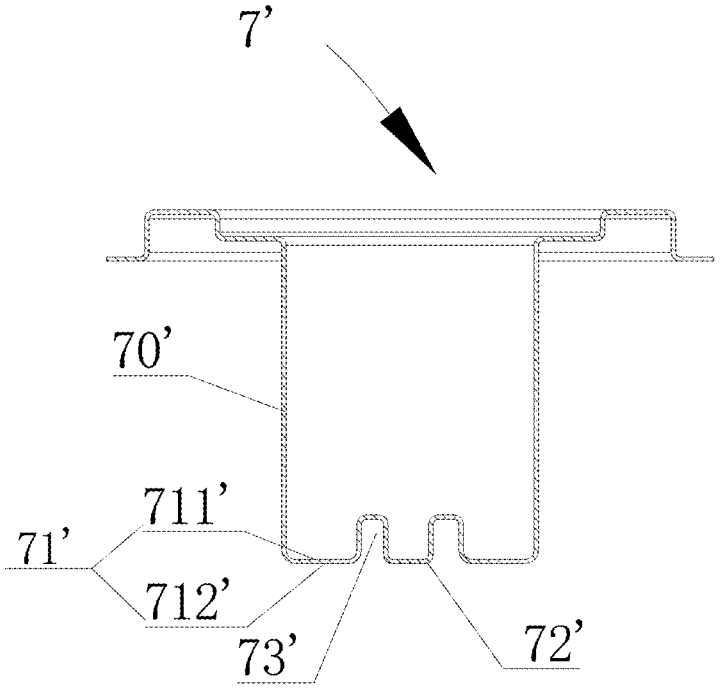
FIG. 17 is a schematic sectional view of the isolation sleeve shown in FIG. 16.

Referring to FIG. 16 and FIG. 17, FIG. 16 and FIG. 17 are schematic structural views of the second embodiment of the isolation sleeve. An isolation sleeve 7' is provided with a pump shaft position-limiting portion 72', and the pump shaft position-limiting portion 72' protrudes toward the second chamber 40. A lower surface 712' of a bottom portion 71' is formed with an annular recess 73', and the annular recess 73' is closer to the sidewall 70' than the pump shaft position-limiting portion 72'. Referring to FIG. 1, the pump shaft 5 is fixedly connected with the pump shaft position-limiting portion 72', and the lower surface 712' of the bottom portion 71' is arranged in contact with the heat dissipation plate 8, except for the annular recess 73', or the clearance between the lower surface 712' of the bottom portion 71' and the heat dissipation plate 8 is filled with the silicone grease or the silica gel, except for the annular recess 73', or the clearance between the lower surface 712' of the bottom portion 71' and the heat dissipation plate 8 is provided with the heat conducting patches, except for the annular recess 73'. Compared with the first embodiment of the isolation sleeve, the present embodiment can save the central hole 81 of the heat dissipation plate 8 in FIG. 3, thereby saving processing cost and improving the processing efficiency of the heat dissipation plate 8 and the electronic control board 9.

Referring to FIG. 1, FIG. 2, FIG. 9 and FIG. 10, when the electric pump is in operation, the first chamber 30 is filled with the working medium. On the one hand, as shown in FIG. 1, the isolation sleeve 7 is in direct contact with the heat dissipation plate 8, or as shown in FIG. 2, the silicone grease or the silica gel is filled between the bottom portion 71 of the isolation sleeve 7 and at least part of the heat dissipation plate 8; and on the other hand, as shown in FIG. 9, an electronic control board 9' is in direct contact with the heat dissipation plate 8, or as shown in FIG. 10, the silicone grease or the silica gel 90 is filled between the electronic control board 9' and the heat dissipation plate 8, such that the isolation sleeve 7, the heat dissipation plate 8 and the electronic control board are in direct or indirect contact with each other in sequence, and the working medium indirectly takes away part of the heat of the electronic control board 9, thereby enabling the heat dissipation of the electronic control board 9 to be more efficient.

Figure 18:
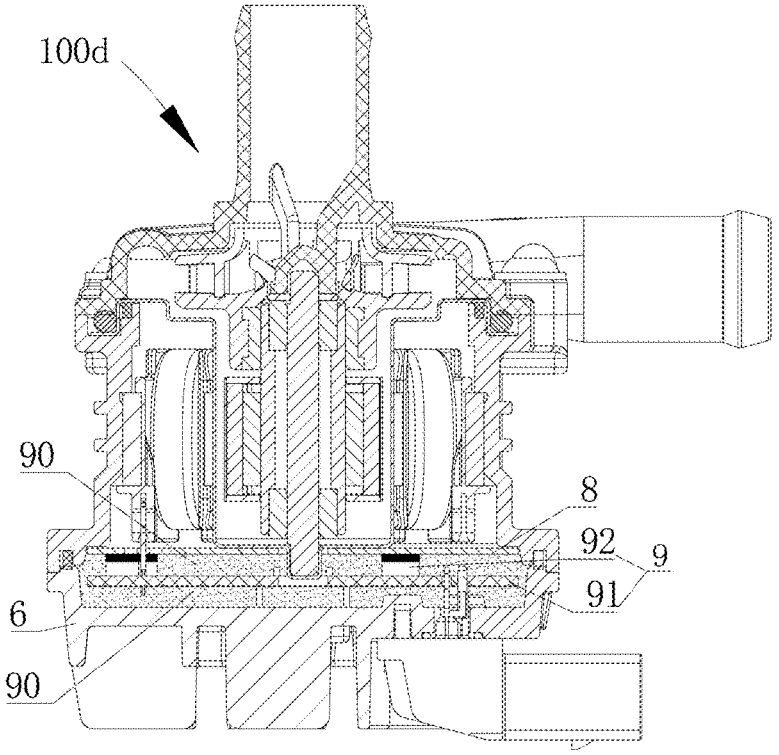
FIG. 18 is a schematic sectional view of a fifth embodiment of the electric pump according to the present application.

Referring to FIG. 18, FIG. 18 is a schematic sectional view of the fifth embodiment of the electric pump according to the present application. An electric pump 100*d* includes the electronic control board 9 and the heat dissipation plate 8, and the electronic control board 9 includes the base board 91 and the electronic components 92. The base board 91 is connected with the electronic components 92. The silicone grease or the silica gel 90 is filled between the base board 91 and the heat dissipation plate 8, or the heat conducting patches are provided between the base board 91 and the heat dissipation plate 92. The pump housing includes the bottom cover 6. The silicone grease or the silica gel 90 is filled between the bottom cover 6 and the base board 91, or the heat conducting patches are provided between the bottom cover 6 and the base board 91. In the present embodiment, the silicone grease or the silica gel 90 is filled between the base board 91 and the heat dissipation plate 8, the silicone grease or the silica gel 90 is also filled between the bottom cover 6 and the base board 91. Apparently, the heat conducting patches may be provided between the base board 91 and the heat dissipation plate 92, the heat conducting patches may also be provided between the bottom cover 6 and the base board 91. Compared with the first embodiment of the electric pump, on the one hand, such an arrangement increases the area of the silicone grease or the silica gel or the heat conducting patches, thereby improving the heat dissipation efficiency of the electronic control board 9, and on the other hand, the silicone grease or the silica gel or the heat conducting patches arranged between the bottom cover 6 and the base board 91 allows part of the heat of the electronic control board 9 to be dissipated through the bottom cover 6, thereby facilitating the heat dissipation of the electronic control board 9. In the present embodiment, the electronic components 92 are arranged between the base board 91 and the heat dissipation plate 8. Apparently, the electronic components may be arranged between the bottom cover 6 and the base board 91. Other features of the present embodiment are the same as those of the first embodiment of the electric pump, and will not be described herein again.

Figure 19:
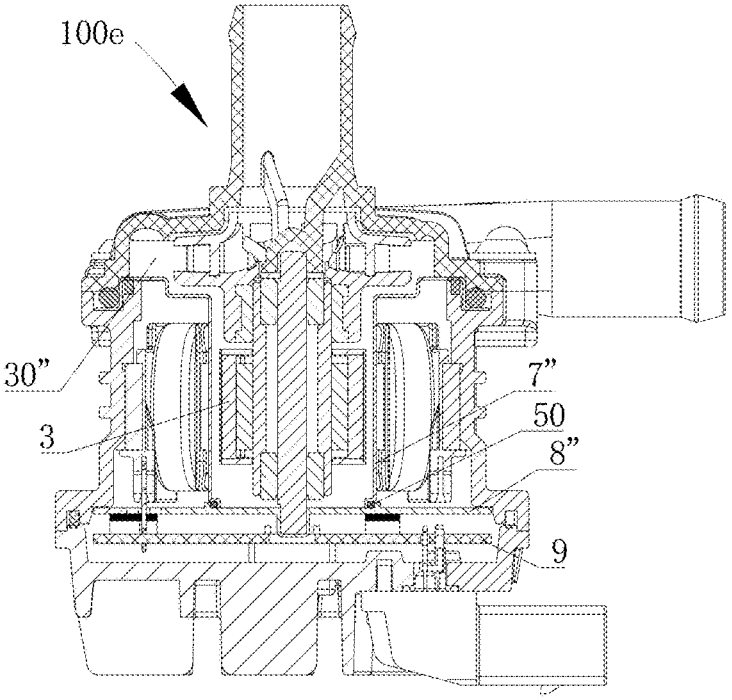
FIG. 19 is a schematic sectional view of a sixth embodiment of the electric pump according to the present application.
Figure 20:
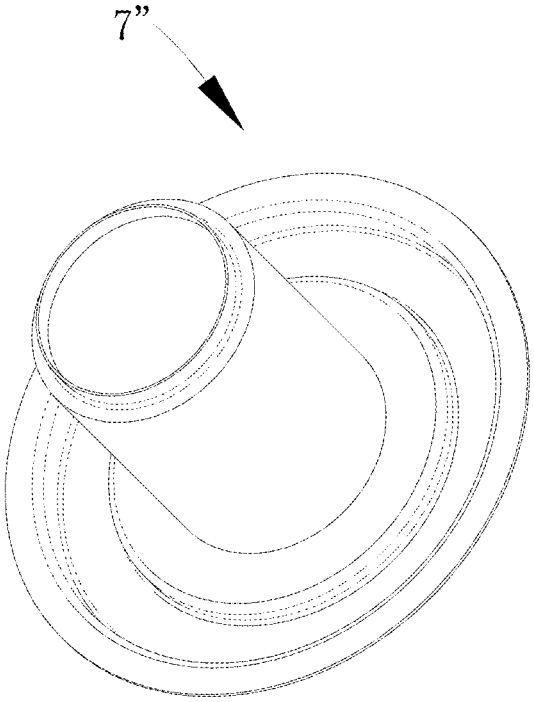
FIG. 20 is a schematic perspective view of the isolation sleeve shown in FIG. 19.
Figure 21:
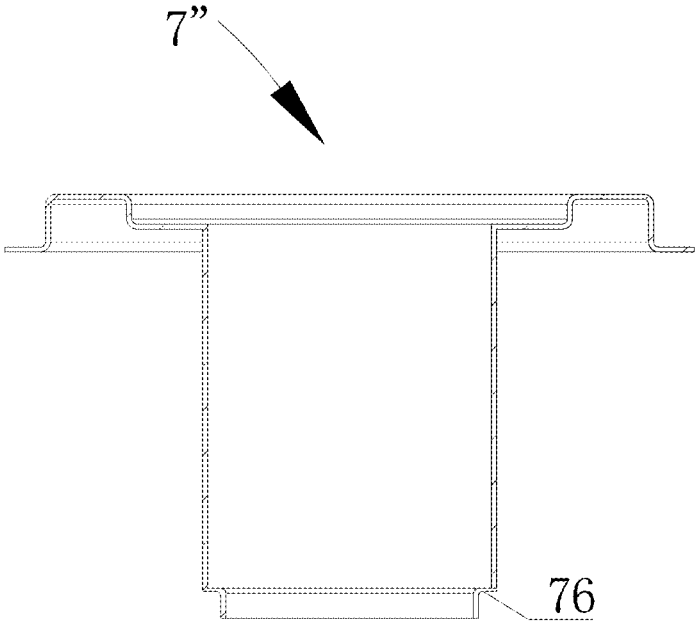
FIG. 21 is a schematic sectional view of the isolation sleeve shown in FIG. 20.

Referring to FIG. 19 to FIG. 21, FIG. 19 is a schematic sectional view of the sixth embodiment of the electric pump according to the present application. FIG. 20 and FIG. 21 are schematic structural views of the isolation sleeve in FIG. 18. In the present embodiment, an electric pump 100*e* includes an isolation sleeve 7", and at least part of the isolation sleeve 7" is arranged on the periphery of the rotor assembly 3. The electric pump 100*e* further includes a heat dissipation plate 8", and at least part of the heat dissipation plate 8" is arranged between the isolation sleeve 7" and the electronic control board 9. Compared with other embodiments of the electric pump, in the present embodiment, a first chamber 30" includes a chamber formed by part of the heat dissipation plate 8" and the isolation sleeve 7". In the present embodiment, the isolation sleeve 7" is cylindrical, and a support portion of the pump shaft is not arranged on the isolation sleeve 7", but is arranged on the heat dissipation plate 8". When the electric pump 100*e* is in operation, part of the working medium can be in direct contact with part of the heat dissipation plate. In order to match with the structure of the isolation sleeve in the present embodiment, the electric pump 100*e* is provided with a sealing portion 50, which can prevent the leakage of the working medium. In the present embodiment, the sealing portion 50 is arranged on the periphery of the isolation sleeve 7". Apparently, the sealing portion 50 may be arranged on other portions to achieve a sealing effect. In the present embodiment, in order to facilitate the installation of the sealing portion 50, the isolation sleeve 7" is provided with a step portion 76. Apparently, the isolation sleeve 7" may not include the step portion 76, and in this case, the sealing portion 50 may be arranged on other portions. Compared with other embodiments of the electric pump and the isolation sleeve, on the one hand, the processing method of the isolation sleeve in the present embodiment is relatively simpler, thereby facilitating reducing the processing cost, and on the other hand, part of the working medium can be in contact with the part of the heat dissipation plate, thereby improving the heat dissipation efficiency of the electronic control board. Other features of the present embodiment are the same as those of other embodiments of the electric pump and the isolation sleeve, and will not be described herein again.

It should be noted that, the above embodiments are merely for illustrating the present application, and are not intended to limit the technical solutions described in the present application. Although the present application is described in detail with reference to the above embodiments, it should be understood by those skilled in the art that, various modifications and equivalents can be made to the technical solutions of the present application without departing from the spirit and scope of the present application, all of which should be contained within the scope of the claims of the present application.

The invention claimed is:

1. An electric pump, comprising a pump housing, a rotor assembly, a stator assembly and an electronic control board, wherein the pump housing is provided with a pump inner chamber, the pump inner chamber comprises a first chamber and a second chamber, the rotor assembly is arranged in the first chamber, and the stator assembly and the electronic control board are arranged in the second chamber; the electric pump comprises an isolation sleeve, at least part of the isolation sleeve is arranged between the rotor assembly and the stator assembly, the first chamber is arranged on one side of the isolation sleeve, and the second chamber is arranged on another side of the isolation sleeve;

the electric pump further comprises a heat dissipation plate, the isolation sleeve comprises a bottom portion, at least part of the heat dissipation plate is arranged between the electronic control board and the bottom portion; and at least part of the bottom portion is in direct contact with at least part of the heat dissipation plate, or silicone grease or silica gel is filled between at least part of the bottom portion and at least part of the heat dissipation plate, or a heat conducting patch is provided between at least part of the bottom portion and at least part of the heat dissipation plate, the isolation sleeve is provided with a pump shaft position-limiting portion which protrudes from the bottom portion of the isolation sleeve toward the second chamber and penetrates through the heat dissipation plate, the heat dissipation plate is provided with a through hole corresponding to the pump shaft position-limiting portion, and the pump shaft position-limiting portion is configured to pass through the through hole and be positioned to the heat dissipation plate.

2. The electric pump according to claim 1, wherein the electronic control board comprises a base board and electronic components, the base board comprises a front surface and a back surface, the front surface and the back surface are arranged substantially in parallel, the front surface is closer to the isolation sleeve than the back surface, and at least part of the electronic components are arranged on the back surface of the base board; the heat dissipation plate is made of metal; and at least part of the heat dissipation plate and the front surface are in direct contact, or the silicone grease or the silica gel is filled between at least part of the heat dissipation plate and the front surface, or the heat conducting patch is provided between at least part of the heat dissipation plate and the front surface.

3. The electric pump according to claim 2, wherein the heat dissipation plate comprises a first surface;

at least part of the first surface is in direct contact with the front surface, or the silicone grease or the silica gel is filled between at least part of the first surface and at least part of the front surface, or the heat conducting patch is provided between at least part of the first surface and at least part of the front surface; and an area of the first surface is defined as a first area, a zone of the base board covered by the electronic components is defined as a first zone, an area of the first zone is defined as a second area, and the first area is greater than or equal to the second area.

4. The electric pump according to claim 1, wherein the electronic control board comprises a base board and electronic components, the base board comprises a front surface and a back surface, the front surface and the back surface are arranged substantially in parallel, the front surface is closer to the isolation sleeve than the back surface, the front surface is arranged opposite to the heat dissipation plate, a gap is formed between the front surface and the heat dissipation plate, at least part of the electronic components are arranged on the front surface, and at least part of the electronic components are located in the gap.

5. The electric pump according to claim 4, wherein the electronic components comprise heat-generating electronic components, and at least part of the heat-generating electronic components are arranged on the front surface of the base board;

the heat dissipation plate is made of metal; and at least part of the heat dissipation plate is in direct contact with at least part of the heat-generating electronic components, or the silicone grease or the silica gel is filled between at least part of the heat dissipation plate and at least part of the heat-generating electronic components, or the heat conducting patch is provided between at least part of the heat dissipation plate and at least part of the heat-generating electronic components.

6. The electric pump according to claim 5, wherein the heat dissipation plate comprises a first surface, at least part of the first surface is in direct contact with at least part of the heat-generating electronic components, or the silicone grease or the silica gel is filled between at least part of the first surface of the heat dissipation plate and at least part of the heat-generating electronic components; and an area of the first surface is defined as a first area, a zone of the base board covered by the heat-generating electronic components is defined as a first zone, an area of the first zone is defined as a second area, and the first area is greater than or equal to the second area.

7. The electric pump according to claim 1, wherein the heat dissipation plate and the pump housing are separately arranged, the heat dissipation plate comprises a plurality of through holes, and the through holes are distributed in a circumferential array or evenly distributed; and the pump housing comprises a plurality of columns, the columns are distributed in the circumferential array or evenly distributed, the columns are integrally formed or fixedly connected with the pump housing, the through holes are arranged corresponding to the columns, and the heat dissipation plate is fixedly connected with the pump housing by riveting the columns.

8. The electric pump according to claim 1, wherein the heat dissipation plate and the pump housing are separately arranged, the heat dissipation plate comprises a plurality of through holes, and the through holes are distributed in a circumferential array or evenly distributed; and the pump housing is formed with a plurality of threaded holes, the threaded holes are distributed in the circumferential array or evenly distributed, the through holes are arranged corresponding to the threaded holes, the electric pump comprises screws or bolts, and the screws or bolts passing through the through holes are in threaded connection with the pump housing having the threaded holes.

9. The electric pump according to claim 1, wherein the isolation sleeve further comprises a sidewall, the sidewall is configured to isolate the stator assembly from the rotor assembly, and the sidewall is made of metal having low or no magnetic permeability.

10. The electric pump according to claim 9, wherein the isolation sleeve is made of austenitic stainless steel, the isolation sleeve is formed by stamping and stretching a metal plate, and a thickness of the sidewall is less than or equal to 1.5 mm.

11. The electric pump according to claim 1, wherein the isolation sleeve further comprises a sidewall, the sidewall is configured to isolate the stator assembly from the rotor assembly, a thickness of the sidewall is less than or equal to a thickness of the bottom portion, the isolation sleeve is made of austenitic stainless steel, the isolation sleeve is formed by stamping and stretching a metal plate, and the thickness of the sidewall is less than or equal to 1.5 mm.

12. The electric pump according to claim 11, wherein a lower surface of the bottom portion is in contact with the heat dissipation plate, except for the pump shaft position-limiting portion, or a clearance between the lower surface of the bottom portion and the heat dissipation plate is filled with the silicone grease or the silica gel, except for the pump shaft position-limiting portion, or the clearance between the lower surface of the bottom portion and the heat dissipation plate is provided with the heat conducting patch, except for the pump shaft position-limiting portion.

13. The electric pump according to claim 1, wherein the electronic control board comprises the base board and the electronic components, and the base board is connected with the electronic components;

the silicone grease or the silica gel is filled between the base board and the heat dissipation plate, or the heat conducting patch is arranged between the base board and the heat dissipation plate; and the pump housing comprises a bottom cover, the silicone grease or the silica gel is filled between the bottom cover and the base board, or the heat conducting patch is provided between the bottom cover and the base board.

* * * * *